US009153170B2

(12) United States Patent
Yoo

(10) Patent No.: US 9,153,170 B2
(45) Date of Patent: Oct. 6, 2015

(54) DISPLAY DEVICE AND METHOD FOR DRIVING THE DISPLAY DEVICE AT DIFFERENT POWER SOURCE VOLTAGE LEVELS

(75) Inventor: Myoung-Hwan Yoo, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 589 days.

(21) Appl. No.: 13/431,213

(22) Filed: Mar. 27, 2012

(65) Prior Publication Data

US 2013/0127815 A1 May 23, 2013

(30) Foreign Application Priority Data

Nov. 18, 2011 (KR) ..... 10-2011-0121134

(51) Int. Cl.
*G09G 3/32* (2006.01)

(52) U.S. Cl.
CPC ..... *G09G 3/3233* (2013.01); *G09G 2300/0852* (2013.01); *G09G 2300/0861* (2013.01)

(58) Field of Classification Search
CPC ..... G09G 3/3233
USPC ..... 345/82
See application file for complete search history.

(56) References Cited

U.S. PATENT DOCUMENTS 6,229,506 B1 * 5/2001 Dawson et al. ..... 345/82
6,734,636 B2 * 5/2004 Sanford et al. ..... 315/169.3
2003/0067424 A1 * 4/2003 Akimoto et al. ..... 345/55
2004/0174349 A1 * 9/2004 Libsch et al. ..... 345/204
2006/0012310 A1 * 1/2006 Chen et al. ..... 315/169.3
2006/0097966 A1 * 5/2006 Choi ..... 345/77
2008/0246698 A1 * 10/2008 Eom ..... 345/76
2009/0140661 A1 * 6/2009 Park et al. ..... 315/169.3
2009/0284519 A1 * 11/2009 Kim et al. ..... 345/213
2010/0103081 A1 * 4/2010 Takasugi et al. ..... 345/45
2010/0117937 A1 * 5/2010 Kim et al. ..... 345/76
2010/0141644 A1 * 6/2010 Lee et al. ..... 345/214
2011/0025671 A1 * 2/2011 Lee ..... 345/211
2011/0090208 A1 * 4/2011 Long et al. ..... 345/211
2011/0109531 A1 * 5/2011 Choi ..... 345/76
2011/0279484 A1 * 11/2011 Han et al. ..... 345/690
2012/0007848 A1 * 1/2012 Han et al. ..... 345/212

(Continued)

FOREIGN PATENT DOCUMENTS

KR 10-2005-0067259 A 7/2005
KR 10-2009-0127771 A 12/2009

(Continued)

*Primary Examiner* — Gregory J Tryder
*Assistant Examiner* — Robert Stone
(74) *Attorney, Agent, or Firm* — Lee & Morse, P.C.

(57) ABSTRACT

A display device includes a display unit having a plurality of pixel, a scan driver that sequentially applies scan signals at a first voltage level to the plurality of pixels, a data driver that writes data by applying data signals to the plurality of pixels to correspond to the scan signals at the first voltage level, and a power source controller that supplies a first power source voltage and a second power source voltage to the plurality of pixels. The power source controller maintains the first power source voltage and the second power source voltage at the second voltage level while the data are written, and allows the plurality of pixels to which data are written to emit light by changing the first power source voltage into a third voltage level and the second power source voltage into the first voltage level after writing is complete.

11 Claims, 5 Drawing Sheets

(56) References Cited

U.S. PATENT DOCUMENTS

| | | | | |
|---|---|---|---|---|
| 2012/0235973 | A1* | 9/2012 | Yoo | 345/211 |
| 2013/0127932 | A1* | 5/2013 | Han | 345/691 |

FOREIGN PATENT DOCUMENTS

| | | | |
|---|---|---|---|
| KR | 10-2010-0060202 | A | 6/2010 |
| KR | 10-2011-0013693 | A | 2/2011 |

* cited by examiner

DISPLAY DEVICE AND METHOD FOR DRIVING THE DISPLAY DEVICE AT DIFFERENT POWER SOURCE VOLTAGE LEVELS

CROSS-REFERENCE TO RELATED APPLICATION

Korean Patent Application No. 10-2011-0121134, filed on Nov. 18, 2011, in the Korean Intellectual Property Office, and entitled "Display Device and Driving Method Thereof," is incorporated herein by reference in its entirety.

BACKGROUND

1. Field

Embodiments relate to a display device and a method for driving the same, and more particularly, to a display device that can decrease power consumption and a method for driving the same.

2. Description of the Related Art

An organic light emitting display device uses an organic light emitting diode (OLED) in which luminance is controlled by a current. The organic light emitting diode (OLED) includes an anode layer and cathode layer for forming an electric field, and an organic light emitting material emitting light by the electric field.

Generally, the organic light emitting diode (OLED) display is classified into a passive matrix OLED (PMOLED) and an active matrix OLED (AMOLED) according to a driving manner. Among these, in view of resolution, contrast, and operation speed, the AMOLED that is selectively turned-on for every unit pixel is mainly used.

One pixel of the AMOLED includes the organic light emitting diode, a driving transistor that controls a current amount that is supplied to the organic light emitting diode, and a switching transistor that transmits the data voltage that controls the light emitting amount of the organic light emitting diode to the driving transistor. The switching transistor is turned-on by a scan signal at a gate on voltage.

In a known organic light emitting diode display, a gate off voltage at a scan signal is set at a voltage ELVDD level at which a pixel emits light. In addition, the data signal is set at a voltage ELVDD level for a period other than data writing. This results in increasing power consumption needed to write data on the pixel, and a time of turning on and off the switching transistor and a data writing time being long.

The above information disclosed in this Background section is only for enhancement of understanding of the background of the invention and therefore it may contain information that does not form the prior art that is already known in this country to a person of ordinary skill in the art.

SUMMARY

One or more exemplary embodiments provides a display device, including: a display unit that includes a plurality of scan lines and a plurality of data lines, and a plurality of pixels formed in an area in which the plurality of scan lines and the plurality of data lines cross each other; a scan driver that sequentially applies a plurality of scan signals at a first voltage level to the plurality of scan lines for a scan period; a data driver that applies a plurality of data signals to the plurality of data lines to correspond to the scan signals at the first voltage level for the scan period; and a power source controller that supplies a first power source voltage and a second power source voltage to the plurality of pixels, wherein the power source controller maintains the first power source voltage and the second power source voltage at the second voltage level for the scan period, and allows the plurality of pixels to emit light by changing the first power source voltage into a third voltage level and changing the second power source voltage into the first voltage level after data writing is completed on the plurality of pixels.

The plurality of pixels may include an organic light emitting diode (OLED) connected to the second power source voltage; a driving transistor that connects the first power source voltage to an anode of the organic light emitting diode (OLED); a compensation transistor that connects the anode of the organic light emitting diode (OLED) to a gate electrode of the driving transistor; and a switching transistor that transmits a data signal to the gate electrode of the driving transistor.

The display device may further include a compensation control signal unit that generates a compensation control signal turning on or off the compensation transistor.

The power source controller may decrease the first power source voltage from the second voltage level to the first voltage level, turn on the driving transistor by maintaining the second power source voltage at the second voltage level, and reset an anode voltage of the organic light emitting diode (OLED) to the first voltage level by allowing a current to flow from the anode of the organic light emitting diode (OLED) to the first power source voltage through the turned-on driving transistor.

When the anode voltage of the organic light emitting diode (OLED) is reset to the first voltage level, the scan driver may apply the scan signal at the second voltage level, and the compensation control signal unit may apply the compensation control signal at the second voltage level.

The power source controller may maintain the first power source voltage and the second power source voltage at the second voltage level, and the compensation control signal unit may turn on the compensation transistor by applying the compensation control signal at the first voltage level, such that voltage from which a threshold voltage of the driving transistor is subtracted from the first power source voltage at the second voltage level is supplied to the gate electrode of the driving transistor.

When the voltage from which the threshold voltage of the driving transistor is subtracted from the first power source voltage at the second voltage level is supplied to the gate electrode of the driving transistor, the data driver may apply the data signal at the second voltage level, and the scan driver may turn on the switching transistor by applying the scan signal at the first voltage level and transmit the data signal at the second voltage level to the gate electrode of the driving transistor.

When the voltage from which the threshold voltage of the driving transistor is subtracted from the first power source voltage at the second voltage level is supplied to the gate electrode of the driving transistor, the data driver may apply the data signal at a middle voltage between the first voltage level and the second voltage level from a finishing point at a second period for which the compensation transistor is turned-on to a finishing point at a first period for which the switching transistor is turned-on.

When a plurality of pixels on which the data is written emit light, the scan driver applies the scan signal at the third voltage level, the compensation control signal unit may apply the compensation control signal at the third voltage level, and the data driver may apply the data signal at the second voltage level.

One or more exemplary embodiments provides a method for driving a display device, including: a reset step for decreasing a first power source voltage connected to the driving transistor from a second voltage level to a first voltage level, turning on the driving transistor by maintaining a second power source voltage connected to a cathode at an organic light emitting diode (OLED) at the second voltage level, and resetting an anode voltage of the organic light emitting diode (OLED) at the first voltage level by flowing a current from the anode of the organic light emitting diode to the first power source voltage through the turned-on driving transistor; a compensation step for turning on the compensation transistor by a compensation control signal at the first voltage level, and supplying voltage in which a threshold voltage of the driving transistor is subtracted from the second voltage level, to the gate electrode of the driving transistor; a scan step for reflecting a change amount of voltage according to the data signal transmitted through the turned-on switching transistor in a gate electrode voltage of the driving transistor; and a light emission step for turning on the driving transistor by increasing the first power source voltage from the second voltage level to the third voltage level and decreasing the second power source voltage from the second voltage level to the first voltage level, and allowing the organic light emitting diode (OLED) to emit light.

The reset step may include applying the scan signal at the second voltage level to the gate electrode of the switching transistor, and applying the compensation control signal at the second voltage level to the gate electrode of the compensation transistor.

The compensation step may include maintaining the first power source voltage and the second power source voltage at the second voltage level.

The compensation step may further include turning on the switching transistor by applying a scan signal at the first voltage level to the switching transistor for a first period including a second period for which the compensation transistor is turned-on.

The compensation step may further include transmitting the data signal at the second voltage level to the gate electrode of the driving transistor through the turned-on switching transistor.

The compensation step may further include applying the data signal at a middle voltage between the first voltage level and the second voltage level from the finishing point of the second period to the finishing point of the first period.

The scan step may include maintaining the first power source voltage, the second power source voltage, and the compensation control signal at the second voltage level.

The light emission step may include applying the scan signal and the compensation control signal at the third voltage level, and applying the data signal at the second voltage level.

One or more exemplary embodiment provides a method for driving a display device, including: writing data on a plurality of pixels by sequentially applying scan signals at a first voltage level to a plurality of scan lines connected to the plurality of pixels, and applying data signals having a voltage range from a first voltage level to a second voltage level to a plurality of data lines connected to the plurality of pixels to correspond to the scan signals at the first voltage level; and maintaining a first power source voltage and a second power source voltage providing a driving current of the plurality of pixels at the second voltage level while data are written on the plurality of pixels, and allowing the plurality of pixels on which data is written to emit light by changing the first power source voltage into a third voltage level and changing the second power source voltage into the first voltage level after data writing is completed on the plurality of pixels.

The second voltage level may be higher than the first voltage level, and the third voltage level may be higher than the second voltage level.

The method for driving a display device may further include resetting a driving voltage at an organic light emitting diode (OLED) by including the organic light emitting diode (OLED) including an anode connected to the first power source voltage and a cathode connected to the second power source voltage in the plurality of pixels, decreasing the first power source voltage to the first voltage level, and maintaining the second power source voltage at the second voltage level.

DETAILED DESCRIPTION

Figure 1:
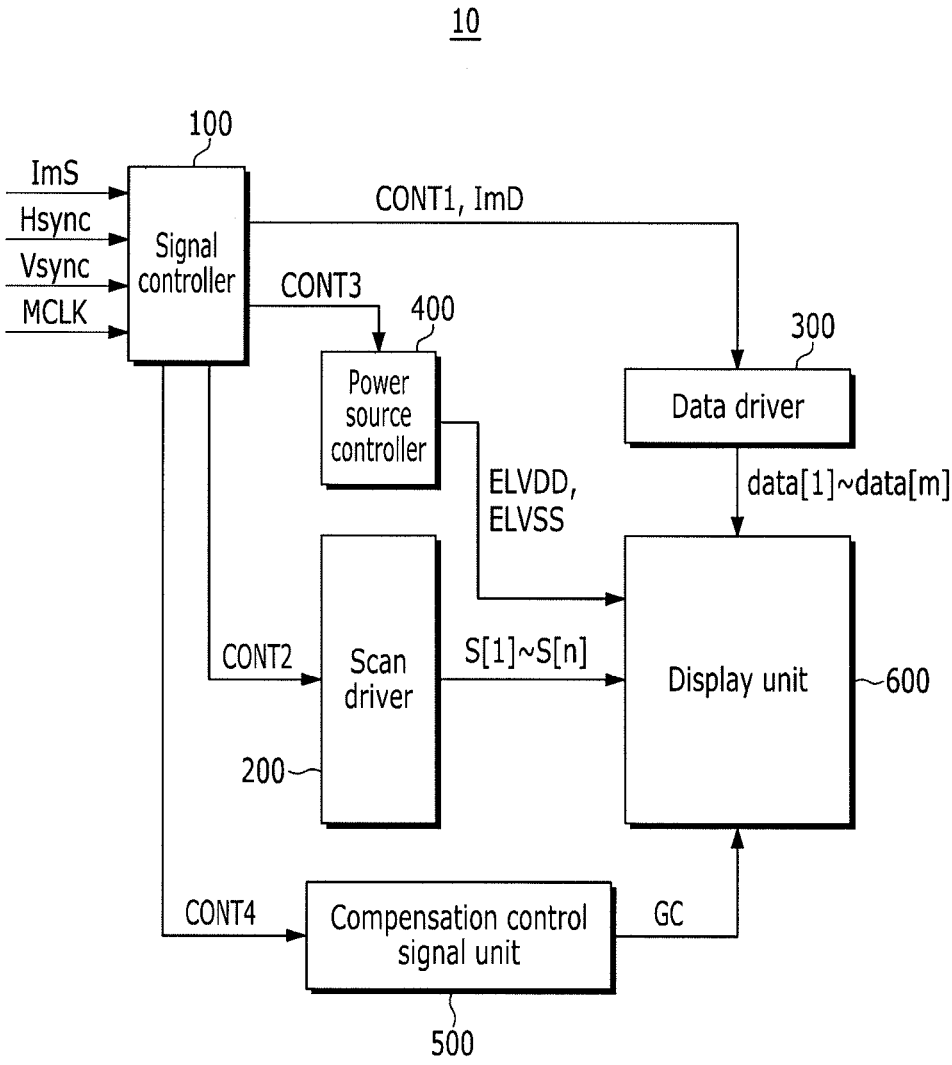
FIG. 1 is a block diagram illustrating a display device according to an example embodiment.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey embodiments to those skilled in the art.

In addition, in various example embodiments, the same reference numerals are used in respect to the constituent elements having the same constitution and illustrated in the first exemplary embodiment, and in the other exemplary embodiment, only constitution that is different from the first exemplary embodiment is illustrated.

The drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising", will be understood to imply the inclusion of stated elements but not the exclusion at any other elements.

FIG. 1 is a block diagram illustrating a display device according to an exemplary embodiment.

Referring to FIG. 1, a display device 10 includes a signal controller 100, a scan driver 200, a data driver 300, a power source controller 400, a compensation control signal unit 500, and a display unit 600.

The signal controller 100 receives a video signal ImS and a synchronization signal input from an external device. The input video signal ImS contains luminance information on a plurality of pixels. The luminance has a predetermined number, for example, $1024=2^{10}$, $256=2^{8}$ or $64=2^{6}$ gray levels. The synchronization signal includes a horizontal synchronization signal Hsync, a vertical synchronization signal Vsync, and a main clock signal MCLK.

The signal controller 100 generates first to fourth driving control signals CONT1, CONT2, CONT3, and CONT4 and an image data signal ImD according to the video signal ImS, the horizontal synchronization signal Hsync, the vertical synchronization signal Vsync, and the main clock signal MCLK.

The signal controller 100 generates an image data signal ImD by classifying the video signals ImS in a frame unit according to the vertical synchronization signal Vsync, and classifying the video signals ImS in a scan line unit according to the horizontal synchronization signal Hsync. The signal controller 100 transmits the image data signal ImD with the first driving control signal CONT1 to the data driver 300.

The display unit 600 is a display area including a plurality of pixels. In the display unit 600, a plurality of scan lines that extend substantially in a row direction to be substantially parallel to each other, a plurality of data lines that extend substantially in a column direction to be substantially parallel to each other, a plurality of power lines, and a plurality of compensation control lines are connected to a plurality of pixels. A plurality of pixels are arranged in an about matrix form in an area in which a plurality of scan lines and a plurality of data lines cross each other.

The scan driver 200 is connected to a plurality of scan lines, and generates a plurality of scan signals S[1]-S[n] according to the second driving control signal CONT2. The scan driver 200 may sequentially apply the scan signals S[1]-S[n] of the gate on voltage to a plurality of scan lines. The scan driver 200 may control a level at a plurality of scan signals S[1]-S[n] into three voltage levels according to a driving step of the display device 10.

The data driver 300 is connected to a plurality of data lines, samples and holds the image data signal ImD input according to the first driving control signal CONT1, and transmits a plurality of data signals data[1]-data[m] to each at a plurality of data lines. The data driver 300 applies a data signal having a predetermined voltage range to a plurality of data lines to correspond to the scan signal S[1] of the gate on voltage.

The power source controller 400 determines the level at a first power source voltage ELVDD and a second power source voltage ELVSS according to the third driving control signal CONT3 to supply the level to a power line connected to a plurality of pixels. The first power source voltage ELVDD and the second power source voltage ELVSS supply a driving current of the pixel. The power source controller 400 may control the first power source voltage ELVDD to the three voltage levels according to the third driving control signal CONT3, and may control the second power source voltage ELVSS to the two voltage levels.

The compensation control signal unit 500 determines the level of the compensation control signal GC according to the fourth driving control signal CONT4 to apply the level to the compensation control line connected to a plurality of pixels. The compensation control signal unit 500 may control the compensation control signal GC to the three voltage levels according to the fourth driving control signal CONT4.

Figure 2:
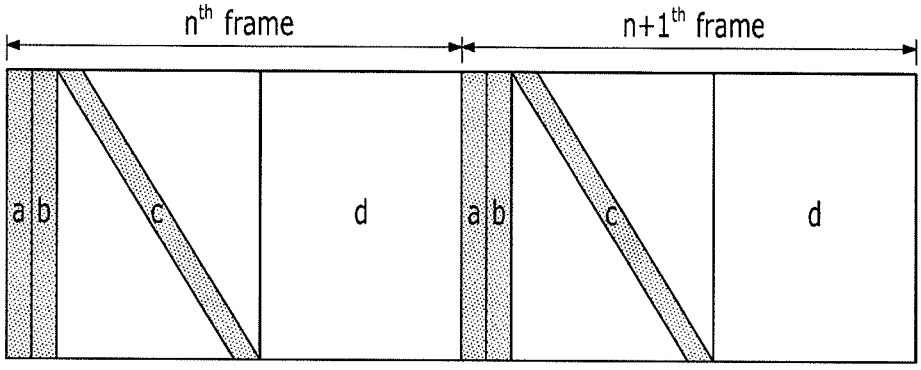
FIG. 2 is a view illustrating a driving operation at a simultaneous light emission manner of the display device according to an example embodiment.

FIG. 2 is a view illustrating a driving operation at a simultaneous light emission manner of the display device according to an example embodiment.

With reference to FIG. 2, the example embodiment will be described under the assumption that the display device is an organic light emitting diode (OLED) display using an organic light emitting diode (OLED). However, embodiments may be applied to various flat panel displays.

One frame period for which one image is displayed in the display unit 600 includes (a) a reset period in which a driving voltage of the organic light emitting diode at a pixel is reset, (b) a compensation period in which a threshold voltage of the driving transistor of the pixel is compensated, (c) a scan period in which data signals are transmitted to each at a plurality of pixels, and (d) a light emitting period in which a plurality of pixels emit light to correspond to the transmitted data signal.

As illustrated in the drawings, operations for (c) the scan period are sequentially performed for each scan line, but operations for (a) the reset period, (b) the threshold voltage compensation period, and (d) the light emitting period are simultaneously performed together in the entire display unit 600.

Figure 3:
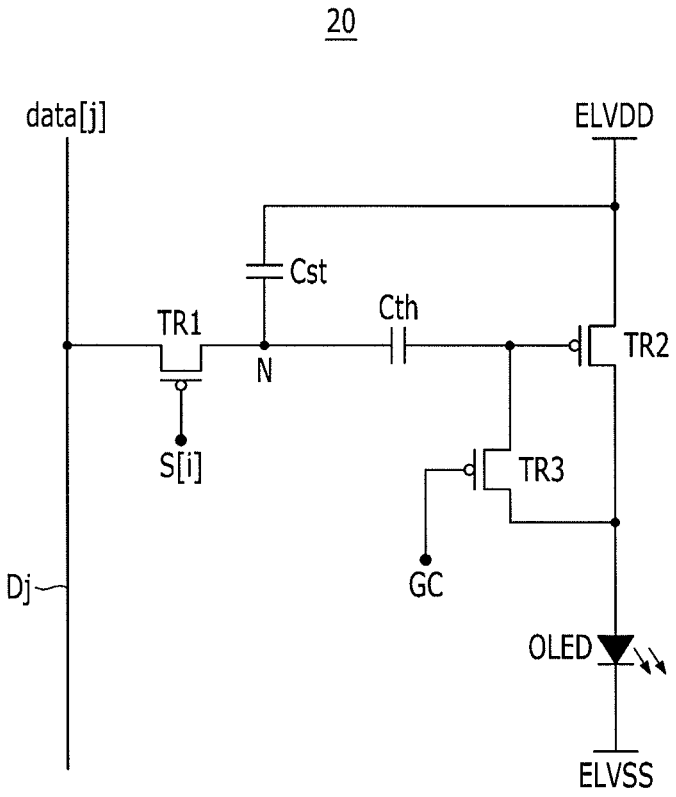
FIG. 3 is a circuit diagram illustrating a pixel according to an example embodiment.

FIG. 3 is a circuit diagram illustrating an example at a pixel according to an example embodiment. FIG. 3 shows any one pixel at a plurality of pixels included in the display device 10 of FIG. 1.

Referring to FIG. 3, the pixel 20 includes a switching transistor TR1, a driving transistor TR2, a compensation transistor TR3, a compensation capacitor Cth, a storage capacitor Cst, and an organic light emitting diode (OLED).

The switching transistor TR1 includes a gate electrode connected to a scan line, a first electrode connected to a data line Dj, and a second electrode connected to an input node N. The switching transistor TR1 is turned-on by a scan signal S[i] at a gate on voltage Von applied to the scan line to transmit a data signal data[j] applied to a data line Dj to the input node N.

The driving transistor TR2 includes a gate electrode connected to the second electrode of the compensation capacitor Cth, a first electrode connected to a first power source voltage ELVDD, and a second electrode connected to an anode of the organic light emitting diode (OLED). The driving transistor TR2 controls a driving current supplied to the organic light emitting diode (OLED).

The compensation transistor TR3 includes a gate electrode connected to the compensation control line, a first electrode connected to the gate electrode of the driving transistor TR2, and a second electrode connected to the anode of the organic light emitting diode (OLED). The compensation transistor TR3 is turned-on/off by the compensation control signal GC.

The compensation capacitor Cth includes a first electrode connected to the input node N and a second electrode connected to the gate electrode of the driving transistor TR2.

The storage capacitor Cst includes a first electrode connected to the input node N and a second electrode connected to the first power source voltage ELVDD.

The organic light emitting diode (OLED) includes the anode connected to the second electrode of the driving transistor TR2 and the cathode connected to the second power source voltage ELVSS. The organic light emitting diode (OLED) can emit one light of primary colors. Examples of the primary colors may include three primary colors of red, green, and blue, and a desired color may be displayed by a spatial sum or a temporal sum of the three primary colors.

The switching transistor TR1, the driving transistor TR2, and the compensation transistor TR3 may be a p-channel field effect transistor. In this case, the gate on voltage that turns on the switching transistor TR1, the driving transistor TR2, and the compensation transistor TR3 is a logic low level voltage, and the gate off voltage that turns on the switching transistor TR1, the driving transistor TR2, and the compensation transistor TR3 is a logic high level voltage.

Herein, the p-channel field effect transistor is illustrated, but at least one of the switching transistor TR1, the driving transistor TR2, and the compensation transistor TR3 may be an n-channel field effect transistor. In this case, the gate on voltage turning on the n-channel field effect transistor is a logic high level voltage, and the gate off voltage turning off the n-channel field effect transistor is a logic low level voltage.

The first power source voltage ELVDD and the second power source voltage ELVSS supply a driving voltage required for operation of the pixel. In detail, the first power source voltage ELVDD has three voltage levels within the reset period (a), the compensation period (b), the scan period (c), and the light emitting period (d). For example, the first power source voltage ELVDD maintains a second voltage level V2 for the compensation period (b) and the scan period (c), changes into a first voltage level V1 for the reset period (a), and changes into a third voltage level V3 for the light emitting period (d).

Hereinafter, the voltage of the first voltage level V1 is a logic low level voltage turning on the switching transistor TR1 and the compensation transistor TR3, and the voltage of the second voltage level V2 is a logic high level voltage turning off the switching transistor TR1 and the compensation transistor TR3. The voltage of the third voltage level V3 may be a high logic high level voltage blocking a leakage current by performing full off of the switching transistor TR1 and the compensation transistor TR3 or may be a light emitting voltage that allows the organic light emitting diode (OLED) to emit light.

The second voltage level V2 is higher than the first voltage level V1, and the third voltage level V3 is higher than the second voltage level V2. For example, when the third voltage level V3 at which the organic light emitting diode (OLED) emits light is 12 V, the first voltage level V1 may be 0 V, and the second voltage level V2 may be 6V.

The second power source voltage ELVSS has two voltage levels within the reset period (a), the compensation period (b), the scan period (c), and the light emitting period (d). In detail, for example, the second power source voltage ELVSS maintains the second voltage level V2 for the reset period (a), the compensation period (b), and the scan period (c), and changes into the first voltage level V1 for the light emitting period (d).

The scan signal S[i] has three voltage levels within to the reset period (a), the compensation period (b), the scan period (c), and the light emitting period (d). In detail, for example, the scan signal S[i] maintains the second voltage level V2 for the reset period (a), changes into the first voltage level V1 for the compensation period (b) and the scan period (c), and changes into the third voltage level V3 for the light emitting period (d).

The compensation control signal GC has three voltage levels according to the reset period (a), the compensation period (b), the scan period (c), and the light emitting period (d). In detail, for example, the compensation control signal GC maintains the second voltage level V2 for the reset period (a) and the scan period (c), changes into the first voltage level V1 for the compensation period (b), and changes into the third voltage level V3 for the light emitting period (d).

The proposed display device may decrease power consumption and a data writing time by using three voltage levels for the first power source voltage ELVDD, the scan signal S[i], and the compensation control signal GC, and using two voltage levels for the second power source voltage ELVSS over the reset period (a), the compensation period (b), the scan period (c), and the light emitting period (d).

A method for driving the display device will be described in detail.

Figure 4:
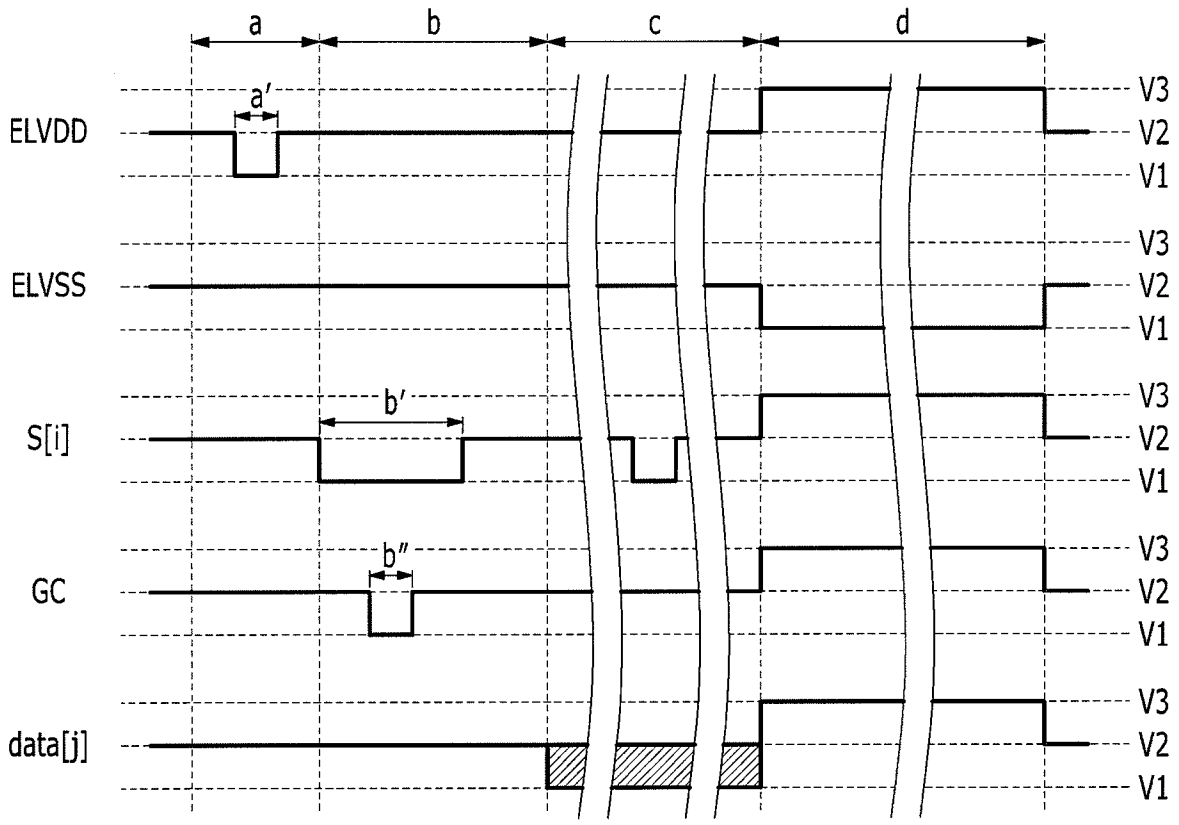
FIG. 4 is a timing diagram illustrating a method for driving the display device according to an example embodiment.

FIG. 4 is a timing diagram illustrating a method for driving the display device according to an example embodiment.

Referring to FIGS. 3 and 4, the second power source voltage ELVSS is maintained at the second voltage level V2 for the reset period (a), and the first power source voltage ELVDD changes into the first voltage level V1 for a predetermined period (a'). In this case, the scan signal S[i], the compensation control signal GC, and the data signal data[j] are maintained at the second voltage level V2.

For the reset period (a), a voltage difference between the first power source voltage ELVDD and the second power source voltage ELVSS is inverted. Accordingly, the anode voltage of the organic light emitting diode (OLED) becomes higher than the first power source voltage ELVDD. Thus, from the standpoint of the driving transistor TR2, the anode of the organic light emitting diode (OLED) becomes a source. The gate voltage of the driving transistor TR2 is approximately similar to the first power source voltage ELVDD, the anode voltage of the organic light emitting diode (OLED) is the sum of the voltages (about 0 to 3 V) stored in the second power source voltage ELVSS and the organic light emitting diode (OLED), which is a voltage that is much higher than the gate voltage. Since the gate-source voltage of the driving transistor TR2 becomes sufficiently negative, the driving transistor TR2 is turned-on. In this case, a current that flows through the driving transistor TR2 flows through the anode of the organic light emitting diode (OLED) at the first power source voltage ELVDD and, finally, flows until the anode voltage of the organic light emitting diode (OLED) becomes identical with the first power source voltage ELVDD.

As described above, the anode voltage of the organic light emitting diode (OLED) becomes a low voltage close to the first voltage level V1 for the reset period (a), such that the reset operation is performed.

When the reset operation is completed for the reset period (a), the first power source voltage ELVDD changes into the second voltage level V2.

For the compensation period (b), the scan signal S[i] changes into the first voltage level V1 for a predetermined first period (b'), and the compensation control signal GC changes into the first voltage level V1 for a predetermined second period (b"). The second period (b") is included in, e.g., is completely overlapped by, the first period (b'). In this case, the first power source voltage ELVDD, the second power source voltage ELVSS, and the data signal data[j] are maintained at the second voltage level V2.

As the scan signal S[i] is applied of the first voltage level V1, the switching transistor TR1 is turned-on, and the data signal data[j] of the second voltage level V2 is transmitted to the input node N. In addition, as the compensation control signal GC is applied of the first voltage level V2, the compensation transistor TR3 is turned-on, and the driving transistor TR2 is connected to the diode. Voltage V2−VTH obtained by subtracting a threshold voltage VTH of the driving transistor TR2 from the first power source voltage ELVDD is supplied to the gate electrode of the driving transistor TR2. In this case, the compensation capacitor Cth is charged with voltage V2−(V2−VTH)=VTH that corresponds to a difference between voltage V2 of the data signal data[j] and the voltage V2−VTH obtained by subtracting the threshold voltage VTH of the driving transistor TR2 from the first power source voltage ELVDD.

As described above, the compensation operation is performed by charging the threshold voltage VTH of the driving transistor TR2 in the compensation capacitor Cth for the compensation period (b).

When the compensation operation is completed for the compensation period (b), the scan signal S[i] and the compensation control signal GC change into the second voltage level V2.

The switching transistor TR1 is turned-on by sequentially changing a plurality of scan signals S[1]-S[n] into the first voltage level V1 for the scan period (c). While the switching transistor TR1 is turned-on, the data signal data[ ] is transmitted to the input node N. In this case, the first power source voltage ELVDD and the second power source voltage ELVSS are maintained at the second voltage level V2.

The second electrode of the compensation capacitor Cth is connected to the gate electrode of the driving transistor TR2 and is in a floating state. A change amount of the voltage of the input node N is distributed according to a volume ratio between the storage capacitor Cst and the compensation capacitor Cth, and a change amount dV of the voltage distributed in the compensation capacitor Cth is reflected in the voltage of the gate electrode of the driving transistor TR2. Accordingly, the voltage of the gate electrode of the driving transistor TR2 becomes V2−VTH+dV for the scan period (c).

As described above, the scan operation is performed by reflecting a voltage corresponding to the change amount dV of the voltage according to the data signal data[j] in the voltage of the gate electrode of the driving transistor VTH for the scan period (c).

When the light emitting period d starts, the first power source voltage ELVDD is changed into the third voltage level V3, and the second power source voltage ELVSS is changed into the first voltage level V1. In this case, the scan signal S[i], the compensation control signal GC, and the data signal data [j] change into the third voltage level V3.

When the scan signal S[i], the compensation control signal GC, and the data signal data[j] change into the third voltage level V3 that is the higher level, a leakage current generated for the light emitting period d may be blocked by performing full off of the switching transistor TR1 and the compensation transistor TR3.

As the first power source voltage ELVDD is increased to the third voltage level V3, and the second power source voltage ELVSS is decreased to the first voltage level V1, in the driving transistor TR2, a driving current according to a difference between the source voltage and the gate voltage occurs. The source voltage of the driving transistor TR2 is the first power source voltage ELVDD at the third voltage level V3, and the gate voltage is V2−VTH+dV. The driving current of the driving transistor TR2 corresponds to a square of the voltage V3−V2−dV obtained by subtracting the threshold voltage VTH from the voltage obtained by subtracting the gate voltage V2−VTH+dV from the source voltage V3. That is, a deviation of the data signal according to the threshold voltage deviation between the driving transistors TR2 at a plurality of pixels does not occur.

When the light emitting period (d) is finished, the first power source voltage ELVDD, the second power source voltage ELVSS, the scan signal S[i], the compensation control signal GC, and the data signal data[j] change into the second voltage level V2.

By the proposed method, when the light emitting voltage that allows the organic light emitting diode (OLED) to emit light has a voltage range of V1 to V3, the voltage range of the scan signal S[i] turning on and off the switching transistor TR1 for the reset period (a), the compensation period (b), and the scan period (c) is V1 to V2, which is about a half of the voltage range of the light emitting voltage. In addition, the data signal data[j] has the voltage range of V1 to V2, that is, about the half of the voltage range of the light emitting voltage for the reset period (a), the compensation period (b), the scan period (c), and the light emitting period (d).

Accordingly, as compared to the case where the voltage range of the scan signal S[i] and the data signal data[j] is identical with the voltage range of the light emitting voltage, in the proposed method, a current turning on and off the switching transistor TR1 and a current charging the storage capacitor Cst may be decreased by half. When the voltage and current are decreased by half, the driving power consumption is decreased by ¼.

Figure 5:
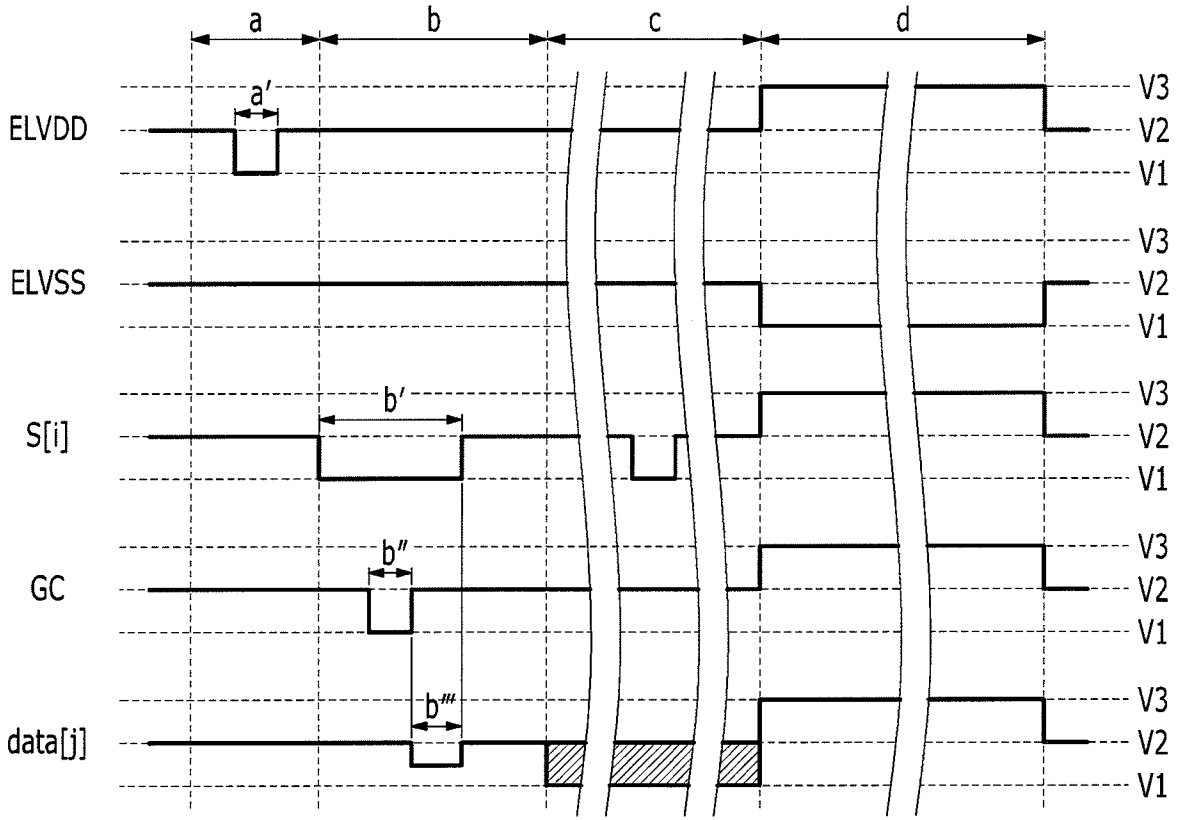
FIG. 5 is a timing diagram illustrating a method for driving the display device according to an example embodiment.

FIG. 5 is a timing diagram illustrating a method for driving the display device according to an example embodiment.

Referring to FIG. 5, as a difference with the driving method of FIG. 4, for the compensation period (b), for a pseudo-input period b''' from a point at which the compensation control signal GC changes from the first voltage level V1 to the second voltage level V2 to a point at which the scan signal S[i] changes from the first voltage level V1 to the second voltage level V2, the voltage level of the data signal data[j] is applied at a half of the voltage of the second voltage level V2, that is, a middle voltage between the first voltage level V1 and the second voltage level V2. Since the other periods are the same, the same reference numerals are used, and a detailed description thereof will be omitted.

The switching transistor TR1 is maintained in a turn-on state by the scan signal S[i] at the first voltage level V1 for the pseudo-input period V. Since the compensation control signal GC is applied at the second voltage level V2, the compensation transistor TR3 is turned off, and the second electrode of the compensation capacitor Cth connected to the gate electrode of the driving transistor TR2 is in a floating state.

In this case, the voltage corresponding to a half of the voltage range of the data voltage data[j] is applied to the input node N through the turned-off switching transistor TR1. A change amount of the voltage of the input node N is distributed according to a volume ratio between the storage capacitor Cst and the compensation capacitor Cth, and stored.

If the pseudo-input period b''' is finished and the scan signal S[i] changes from the first voltage level V1 to the second voltage level V2, the input node N is in a floating state and the voltage input to the input node N is maintained.

The switching transistor TR1 is turned-on for the scan period (c), and the data signal data[j] is transmitted to the input node N through the turned-on switching transistor TR1. In this case, since the voltage corresponding to ½ of the voltage range of the data voltage data[j] is previously stored in the input node N, the data voltage data[j] may charge the storage capacitor Cst and the compensation capacitor Cth in about ½ the time.

Accordingly, by the proposed method, a data writing time may be decreased by half, such that a high speed driving at a display device is made possible.

By way of summary and review, one or more embodiments may allow power consumption for driving a display device and/or a data writing time with respect to a pixel to be decreased.

The drawings and the detailed description described above are examples for the present invention and provided to explain the present invention and the scope of the present invention described in the claims is not limited thereto. Therefore, it is understood that various modifications and other equivalent exemplary embodiments may be possible by those who are skilled in the art. Accordingly, the technical scope of the present invention should be determined by the technical spirit of the accompanying claims.

DESCRIPTION OF SYMBOLS

10: Display device
20: Pixel

100: Signal controller
200: Scan driver
300: Data driver
400: Power source controller
500: Compensation control signal unit
600: Display unit

What is claimed is:

1. A display device, comprising:

a display unit that includes a plurality of scan lines and a plurality of data lines, and a plurality of pixels formed in an area in which the plurality of scan lines and the plurality of data lines cross each other;

a scan driver that sequentially applies a plurality of scan signals at a first voltage level to the plurality of scan lines for a scan period;

a data driver that applies a plurality of data signals to the plurality of data lines to correspond to the scan signals at the first voltage level for the scan period;

a power source controller that supplies a first power source voltage and a second power source voltage to the plurality of pixels, wherein the power source controller sets the first power source voltage to the first voltage level, a second voltage level, and a third voltage level in different periods, the power source controller to maintain the first power source voltage and the second power source voltage at the second voltage level for the scan period, and allows the plurality of pixels to emit light by changing the first power source voltage into the third voltage level and changing the second power source voltage into the first voltage level after data writing is completed on the plurality of pixels; and a compensation controller to generate a compensation control signal turning on or off a compensation transistor, wherein:

the power source controller is to maintain the first power source voltage and the second power source voltage at the second voltage level, and the compensation controller is to turn on the compensation transistor by applying the compensation control signal of the first voltage level, such that voltage from which a threshold voltage of a driving transistor is subtracted from the first power source voltage of the second voltage level is supplied to the gate electrode of the driving transistor, and when the voltage from which the threshold voltage of the driving transistor is subtracted from the first power source voltage of the second voltage level is to be supplied to the gate electrode of the driving transistor, the data driver to apply the data signal at a middle voltage between the first voltage level and the second voltage level from an end point of a second period for which the compensation transistor is turned-on to an end point at a first period for which a switching transistor is turned-on.

2. The display device of claim 1, wherein:

the power source controller decreases the first power source voltage from the second voltage level to the first voltage level, turns on the driving transistor by maintaining the second power source voltage at the second voltage level, and resets an anode voltage of the organic light emitting diode (OLED) to the first voltage level by allowing a current to flow from the anode of the organic light emitting diode (OLED) to the first power source voltage through the turned-on driving transistor.

3. The display device of claim 2, wherein:

when the anode voltage of the organic light emitting diode (OLED) is reset to the first voltage level, the scan driver applies the scan signal of the second voltage level, and the compensation controller to apply the compensation control signal of the second voltage level.

4. The display device of claim 1, wherein:

when a plurality of pixels on which the data is written emit light, the scan driver applies the scan signal at the third voltage level, the compensation control signal unit applies the compensation control signal at the third voltage level, and the data driver applies the data signal at the third voltage level.

5. A method for driving a display device including an organic light emitting diode (OLED), a driving transistor connected to an anode of the organic light emitting diode (OLED), and a compensation transistor connected between a gate electrode of the driving transistor and the anode, the method comprising:

in a reset period, decreasing a first power source voltage connected to the driving transistor from a second voltage level to a first voltage level, turning on the driving transistor by maintaining a second power source voltage connected to a cathode of the organic light emitting diode (OLED) at the second voltage level, and resetting an anode voltage of the organic light emitting diode (OLED) at the first voltage level through the turned-on driving transistor;

in a compensation period, turning on the compensation transistor by a compensation control signal at the first voltage level, supplying voltage in which a threshold voltage of the driving transistor is subtracted from the second voltage level to the gate electrode of the driving transistor, maintaining the first power source voltage and the second power source voltage at the second voltage level, turning on a switching transistor by applying a scan signal at the first voltage level to the switching transistor for a first period including a second period for which the compensation transistor is turned-on, transmitting the data signal at the second voltage level to the gate electrode of the driving transistor through the turned-on switching transistor, and applying the data signal at a middle voltage between the first voltage level and the second voltage level from the finishing point of the second period to the finishing point of the first period;

in a scan period, reflecting a change amount at a voltage according to the data signal transmitted through the turned-on switching transistor in a gate electrode voltage of the driving transistor, and applying a scan signal at the first voltage level; and in a light emission period, turning on the driving transistor by increasing the first power source voltage from the second voltage level to a third voltage level and decreasing the second power source voltage from the second voltage level to the first voltage level, and allowing the organic light emitting diode (OLED) to emit light.

6. The method for driving a display device of claim 5, further comprising, in the reset period, applying the scan signal at the second voltage level to the gate electrode of the switching transistor, and applying the compensation control signal at the second voltage level to the gate electrode of the compensation transistor.

7. The method for driving a display device of claim 5, further comprising, in the scan period, maintaining the first power source voltage, the second power source voltage, and the compensation control signal at the second voltage level.

8. The method for driving a display device of claim 5, further comprising, in the light emission period, applying the scan signal and the compensation control signal at the third voltage level, and applying the data signal at the third voltage level.

9. A method for driving a display device, comprising:

setting a first power source voltage to a first voltage level during a reset period;

supplying voltage in which a threshold voltage of a driving transistor is subtracted from a second voltage level to the gate electrode of the driving transistor, maintaining the first power source voltage and a second power source voltage at the second voltage level, applying a data signal at the second voltage level to the gate electrode of the driving transistor during a second period, and applying the data signal at a middle voltage between the first voltage level and the second voltage level from the finishing point of the second period to the finishing point of a first period included in a compensation period;

writing data on a plurality of pixels by sequentially applying scan signals at the first voltage level to a plurality of scan lines in scan period, the scan lines connected to the plurality of pixels, and applying data signals having a voltage range from a first voltage level to a second voltage level to a plurality of data lines connected to the plurality of pixels to correspond to the scan signals at the first voltage level; and maintaining a first power source voltage and a second power source voltage providing a driving current of the plurality of pixel at the second voltage level while data are written on the plurality of pixels, and allowing the plurality of pixels on which data is written to emit light by changing the first power source voltage into a third voltage level and changing the second power source voltage into the first voltage level after data writing is completed on the plurality of pixels.

10. The method for driving a display device of claim 9, wherein:

the second voltage level is higher than the first voltage level, and the third voltage level is higher than the second voltage level.

11. The method for driving a display device of claim 10, further comprising in the reset period:

resetting a driving voltage at an organic light emitting diode (OLED) by including the organic light emitting diode (OLED) including an anode connected to the first power source voltage and a cathode connected to the second power source voltage in the plurality of pixels, and maintaining the second power source voltage at the second voltage level.

* * * * *